United States Patent [19]

Fellot

[11] 4,244,264

[45] Jan. 13, 1981

[54] SYSTEM FOR REGISTERING AND SELECTING STOPS IN A MUSICAL INSTRUMENT

[75] Inventor: Dominique Fellot, Paris, France

[73] Assignee: Thomson-CSF, Paris, France

[21] Appl. No.: 878,869

[22] Filed: Feb. 17, 1978

[30] Foreign Application Priority Data

Feb. 23, 1977 [FR] France ..... 77 05253

[51] Int. Cl.[3] ..... G10B 3/10

[52] U.S. Cl. ..... 84/345; 84/370

[58] Field of Search ..... 84/345, 370, 337, 1.03

[56] References Cited

U.S. PATENT DOCUMENTS

| | | | |
|---|---|---|---|
| 3,926,087 | 12/1975 | Griffis | 84/345 |
| 4,006,658 | 2/1977 | Kappes | 84/345 |
| 4,078,465 | 3/1978 | Wheelwright | 84/345 |

*Primary Examiner*—George H. Miller, Jr.
*Assistant Examiner*—Stafford D. Schreyer
*Attorney, Agent, or Firm*—Karl F. Ross

[57] ABSTRACT

An electronic musical instrument, such as a pipe organ, has a multiplicity of manually and electrically positionable knobs for selecting and restoring respective organ stops, any combination of signals representing selected and unselected stops being recordable in a nonvolatile memory from which that combination can be subsequently read out under the control of a keyboard and a set of pushbuttons. Whenever a new signal combination is called forth from the memory, switching instructions are loaded into a multiplicity of cascaded register stages whose outputs are connected via respective interface circuits to selecting or restoring coils of respective knobs. The interface circuits are unblocked simultaneously by a transfer instruction from the memory to establish the new knob positions. The loading of the register stages is controlled by a unit which compares the existing positions of the knobs with those specified by the selected signal combination and sends switching instructions only to those register stages whose knobs have to be repositioned. A series of cascaded ancillary memories of the read/write type may be loaded with a limited number of signal combinations appearing consecutively in the nonvolatile main memory for facilitating a quick changeover from one of these combinations to another.

12 Claims, 7 Drawing Figures

SET OF CIRCUITS

KNOB ASSY
RETURN SELECT
WIND-CHEST
CORE
DECODING COUNTER
CONDUCTIVE ROWS
CONDUCTIVE COLUMNS
LOW-SPEED CLOCK
REGISTER
HIGH-SPEED CLOCK
+V
INTERFACE CIRCT.
INVERTER
OUTPUT BOARD
MASTER CONTROL CIRCT.
NONVOLATILE MEMORY
REGISTER

OUTPUT BOARD
INTERFACE CIRCT.
SELECTION CONTROL
REGISTER
REGISTER

200
MICROPROCESSOR
AMPL.
AMPL.
AMPL.
201
202
203
207
READ-ONLY MEMORY
214
INTER-FACE ENCODER
100 KEYBOARD
7 8 9
4 5 6
1 2 3
0
216
INTER-FACE
104
DISPLAY
208
READ/WRITE MEMORY
217
INTER-FACE ENCODER
101
PUSH BUTTONS
209
CONTACT MATRIX
210
INTER-FACE
211
INTER-FACE
218
INTERFACE
NONVOLATILE MEMORY
121
212
INTERFACE
204
205
206
80
80
OUTPUT BOARDS

SYSTEM FOR REGISTERING AND SELECTING STOPS IN A MUSICAL INSTRUMENT

FIELD OF THE INVENTION

My present invention relates to a system for selectively controlling the positions of stops in a musical instrument.

BACKGROUND OF THE INVENTION

The musical instrument concerned is in particular a pipe organ which has one or more manual keyboards (or manuals), a pedal-board, and stops for as many pipes or ranks of pipes as there are keys (or pedals) on the keyboard (or pedal-board) with which they are associated.

These organ stops are mounted on a common wind-chest which allows any pipe to emit a sound if the appropriate key or pedal of the keyboard or pedal-board is pressed and if the stop serving the pipe is selected by means of an individual control element or actuator which is generally arranged opposite the corresponding keyboard.

The instrument also includes various couplers which enable one or more keyboards in a position n+k (k=1, 2, etc.) to be operated when a keyboard in position n, or the pedal-board, is operated. Finally it includes one or more bellows which supply air at a regulated pressure.

The pipes are caused to operate by means of valves which are controlled mechanically or electromechanically from the keys, the pedals and the stops.

In the older type of organ, the stops are selected directly by the player by means of a stop knob which moves approximately 10 cm. The movement is transmitted to the wind-chest by rods and bellcranks. As far as is possible, the knobs are generally grouped together opposite the keyboards to which they belong. The manual selection is often supplemented by foot-operated selection (to select mixed stops, reed-stops, etc.), to make the task of the player easier. While playing, the player often needs one stop puller (and sometimes even two) with fast reflexes, which does not simplify matters. Thus, to avoid this, makers have brought out so-called "adjustable combination" systems which simply store certain stop configurations to be called up at will. At the present time, the introduction of electrical controls which enable the stop-actuating knobs to be operated electrically has made it possible for many instruments to have up to 15 adjustable combinations, i.e. to store 15 call-up configurations for 100 or so stops and various couplings of keyboards in a memory formed from a multiplicity of bistable relays. Such an arrangement for selectively positioning the organ stops has the disadvantage of being unreliable and noisy, of consuming considerable energy, and of not allowing the combinations to be conveniently recorded in another memory device.

OBJECTS OF THE INVENTION

It is an object of my invention to avoid or minimize these disadvantages and in particular the poor reliability, the high energy consumption and the limited number of combinations which can be recorded.

A further object is to enable numerous combinations of stops to be selected, the stop combinations remaining in store even when there is no supply of current or any other energy.

A related object of the invention is to allow the combination to be recorded on an economical and easily transportable carrier such as a magnetic medium (flexible disks, for example).

SUMMARY OF THE INVENTION

In accordance with my present invention I provide nonvolatile memory means, e.g. a single-face or double-face magnetic disk or one or more magnetic-bubble memories, loadable with combinations of binary signals identifying the selected and unselected positions of respective stops. A chosen signal combination is read out from the nonvolatile memory means with the aid of player-operated selector means, such as a keyboard and a set of pushbuttons, and is fed to a control unit which converts the signal combination into positioning commands serially entered in a multiplicity of cascaded register stages. The several stage outputs are connected to a multiplicity of actuators, which are independently electrically operable to displace the associated stops between selected and unselected positions, by way of interface circuits serving for the simultaneous transmission of all positioning commands to the respective actuators in response to a transfer instruction emitted by the nonvolatile memory means.

Pursuant to a more specific feature of my invention, the control unit includes comparison means with input connections to the nonvolatile memory means and to a storage register receiving positioning information from all the actuators, the control unit emitting positioning commands only to those register stages whose actuators are associated with stops in positions different from those specified by the read-out signal combination. Advantageously, the several register stages are divided into two groups of cascaded series-input/parallel-output registers respectively receiving selection commands and return commands from the control unit.

Pursuant to a further feature of my invention, a plurality of ancillary read/write memories are serially interposed between the nonvolatile memory means and the control unit for temporarily storing several signal combinations sequentially read out from the nonvolatile memory means in response to address information transmitted thereto from the player-operated selector means. The latter, in that case, includes transfer circuitry for extracting a signal combination from any of the ancillary memories without addressing of the nonvolatile memory means.

Among the advantages of my invention are the large number of combinations available to the player and the possibility of storing recordings of signal combinations on an inexpensive and transportable medium, thereby building up a library of combinations which remain memorized without a constant supply of energy. Furthermore, each recording can be made inerasable if need be; access may be direct or sequential; the cost of the storage medium is low, and its life is long; and, in the event of the arrangement breaking down, the instrument is not put out of action and can be used by the player without any difficulty. Finally, only a very small number of modifications have to be made on an existing instrument for equipping it with a system according to my invention.

BRIEF DESCRIPTION OF THE DRAWING

The above and other features of my invention will become more fully apparent from the following description, given in connection with the accompanying drawing in which.

SPECIFIC DESCRIPTION

The following description refers specifically to a pipe organ. Since this description is merely given by way of example it is to be understood that my invention may also be applied to electronic organs or other instruments which require large numbers of combinations of stops to be memorized and controlled.

A pipe organ has one or more manual keyboards (up to five and even more) which are arranged in steps (the first keyboard being the bottom one), a pedal-board, and stops which each serve as many pipes or ranks of pipes as there are keys (or pedals) in the keyboard (or the pedal-board) to which they are allotted.

Each keyboard and the stops are mounted on a common wind-chest forming part of what may be regarded as a co-ordinate system in which any pipe begins to vibrate if the following conditions are fulfilled simultaneously;

the stop is selected by an individual control element, generally situated opposite the corresponding keyboard; and the appropriate key on the keyboard is pressed.

The organ also includes various couplers which enable one or more keyboards in a position n+k (n and k being whole numbers) to be operated when a keyboard in position n or the pedal-board is operated.

The instrument also includes a bellows which supplies air under pressure for the pipes. This air reaches any of the pipes only after one or more valves have been opened. The valves are generally electrically controlled either from the key or pedal contacts associated with each of the keys or pedals of the keyboards or the pedal-board, or from stop-actuating or coupling-selecting knobs or slides.

Figure 1:
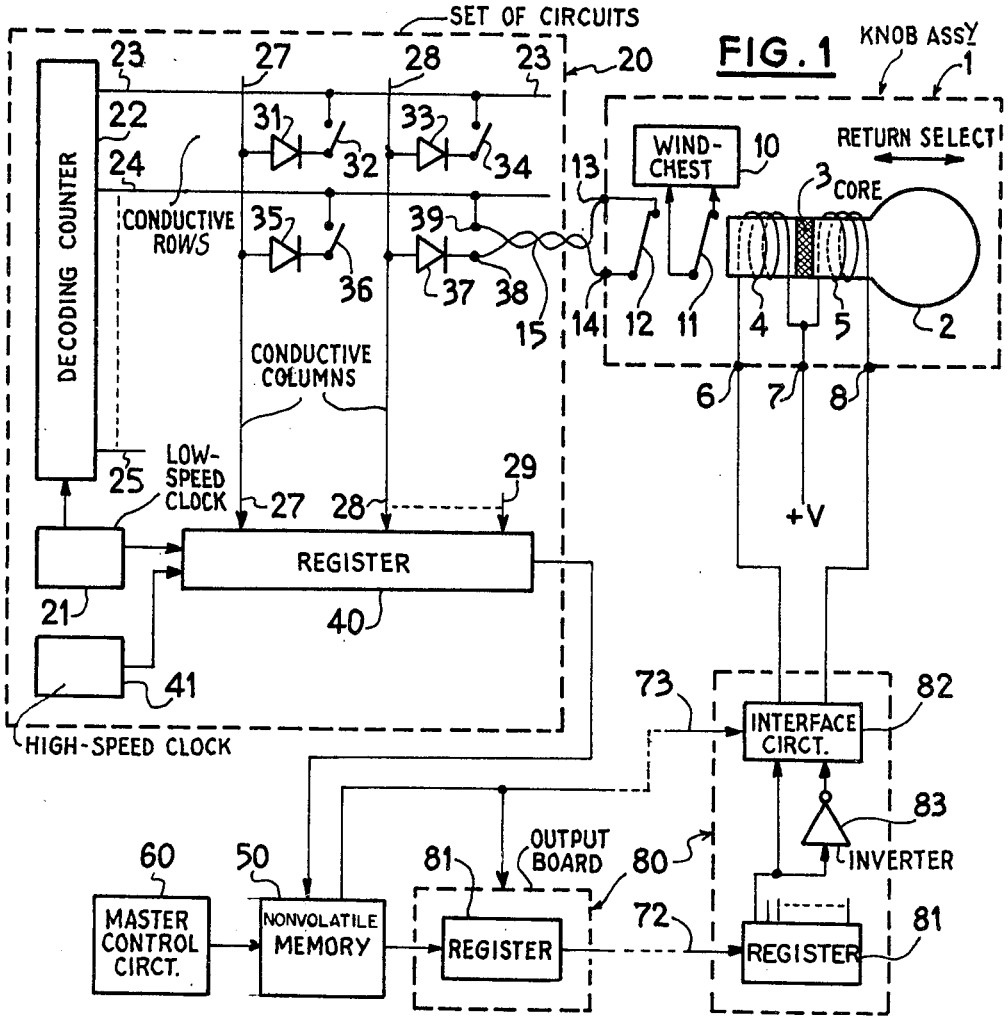
FIG. 1 is a general diagram of a system embodying my invention, with the means for reading the position of a stop-actuating knob and means for controlling the position of this knob shown in detail.

It must be possible at all times for the player to be able to select or return a stop manually. A single stop-actuating knob is shown in FIG. 1 to simplify the Figure. This knob is formed by a movable stem and a head 2 secured to the stem which enables the player to operate the knob. The knob slides between two coils 4 and 5 and causes two switches 11 and 12 to open and close. One of the switches, 11, is electrically connected to the wind-chest 10 of the instrument. It controls an electro-pneumatic valve which allows air for a group of pipes to pass. The second switch 12 is used to indicate the position of the knob, being closed in the pulled-out position (stop selected) and open in the pushed-in position (stop returned). The same also applies to switch 11. A magnetic core 3 is incorporated in the stem of the stop-actuating knob and together with the two coils 4 and 5 forms a bistable relay whose armatures 11, 12 can be reversed either manually or electrically. In effect, there is nothing to prevent the player from operating the knob 2 by hand if no current flows through the coils 4 and 5. If, however, a current flows in coil 4, for example, the magnetic core 3 is attracted and pulls the knob 2 to the pushed-in or unselected position, thus opening contacts 11 and 12. Coil 4 is therefore termed the "return coil". If on the other hand a current flows in coil 5, the core is attracted towards this coil and moves the knob 2 to the pulled-out position, thus closing contacts 11 and 12. Coil 5 is called the "selecting coil". This of course is given only as an example and either coil may either attract or repel the core 3, or again the movement of the knob may depend on the direction of the current in only one coil if the core is formed by a permanent magnet. In the example shown in FIG. 1, it is assumed that the selecting coil 5 and the return coil 4 have a junction connected, via a terminal 7, to a reference potential +V. A terminal 8 connected to the other end of the selecting coil is used to order the appropriate stop to be selected (closure of switch contacts 11 and 12), and a terminal 6 connected to the other end of the return coil is used to restore the stop to its unselected position. Terminals 13 and 14 are used to connect contact 12 to the remainder of the circuitry.

The stop-actuating knobs may take various forms (being swingable instead of slidable, for example) provided that they act as relays having two stable positions, two armatures respectively serving to control the valves of the wind-chest and to allow the state of the knob to be detected, and two coils for selection and return. The number of these knobs or actuators may be as high as 150 or even more.

A set of circuits which are grouped into a block 20 is responsible for forming a sequence of digital signals corresponding to the positions of all the various knobs.

The contact 12 belonging to one of the stop-actuating knobs is connected in series with a diode 37 at the point of intersection between a row and a column of a diode matrix. This matrix contains conductive rows 23, 24 . . . 25 connected to the output of a decoding counter 22, and conductive columns 27, 28 . . . 29 connected to the inputs of a storage register 40 of the parallel-input/series-output kind. Between row 23 and column 27, a diode 31 and a contact 32 belonging to a first actuating knob are connected in series. A diode 33 and a contact 34 are similarly connected between row 23 and column 28. In the same way a diode 35 and a contact 36 are situated between row 24 and column 27 while diode 37 and contact 12 lie between row 24 and column 28. All the knobs or other actuators are thus connected to points of intersection in the diode matrix. In reality, the contacts are located near the actuating knobs and are connected to the matrix by a two-wire line 15 which joins terminals 13 and 14 to terminals 39 and 38 as shown in the Figure.

A low-speed clock 21 supplies pulses to the decoding counter 22. All the outputs of the decoding circuit are in the same logic state, the set ("1") state for example, except one which is in the reset ("0") state. With each new clock pulse, the row which had previously been reset returns to the set state and the next row goes to the reset state. Consider row 24, for example. If the corresponding output 24 of the decoder is set, columns 27, 28 . . . 29 will remain set whatever the state of the contacts connected to row 24. If the corresponding output is in the reset state and contact 36 is open, row 27 remains set. If on the other hand contact 12 is closed, the "0" on row 24 will be transmitted by column 28 to the corresponding input of register 40. Since the same applies to all the contacts which are connected to one and the same row, the columns 27, 28 . . . 29 transmit the state of the corresponding contacts (representative of the selected or unselected positions of the associated organ stops) simultaneously to register 40 in the form of a sequence of digital "0" or "1" signals. With each new pulse from the clock 21, the state of the contacts connected to the next row is read and transferred by the columns to register 40, for entry.

Between two pulses from the low-speed clock 21, a high-speed clock 41 causes the binary-1 signals to be transferred in series from register 40 to a memory 50 of the nonvolatile type.

The recording of the states of the contacts of the stop-actuating knobs in memory 50 and the readout of the recorded combinations is commanded by a master control circuit 60. This circuit may also include display means to show for example the number of the signal combination recorded or read out or to indicate to the player a possible breakdown of the system.

When the memory 50 is read, each combination read out takes the form of a succession of digital signals which are serially transferred to a number of series-input/parallel-output storage registers 81 all connected in cascade. These registers are arranged on a set of logical output boards which are represented by dotted outlines 80 in the Figure. Only one of these boards is shown in detail, namely the last one whose register 81 may have sixteen stages, for example, accommodating as many bits. Each stage output of the register is connected to an interface circuit 82 which enables the selecting and return coils of a stop-actuating knob to be operated with the requisite power upon receiving a transfer instruction from memory 50 via a lead 73. Since only one coil is active at a time in the embodiment shown, the interface circuit 82 comprises two branches, one of which is controlled directly from the corresponding stage output of the associated register 81 and the other of which is controlled from this same output via a logical inverter 83. There are of course sixteen interface circuits 82 assigned to each control board since the register 81 has sixteen outputs, which are thus able to control sixteen actuating knobs.

To give an example, the arrangement according to the invention may enable the reading of the state of 256 contacts which are mounted on stop-actuating knobs and are connected to the points of intersection of a matrix consisting of sixteen rows, tied to the sixteen outputs of the decoding counter 22, and of sixteen columns, tied to the inputs of the sixteen-bit register 40. This register thus emits in succession sixteen words of sixteen bits each, that is to say a total of 256 bits.

The memory 50 may comprise a flexible magnetic disk which may contain, for example, sixty-four tracks each carrying thirty-two 256-bit recordings. The memory is thus able to contain up to 2048 combinations of 256 stop positions each, which constitutes a vast potential for possible stop configurations.

Figure 2:
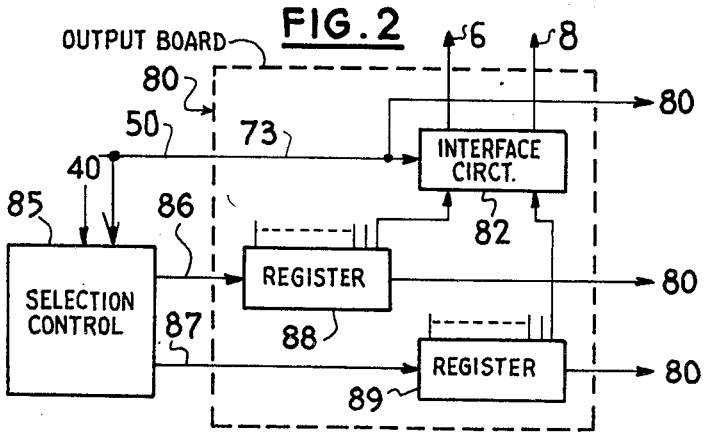
FIG. 2 is a modification of the means for controlling the position of the knob.

A modification of the structure of the boards for controlling the stop-actuating knobs, shown in FIG. 2, allows the selecting and return coils to be activated only in cases where the corresponding knob has to change state. To do this, each control board 80 contains two series-input/parallel-output registers 88 and 89. Register 88 receives only selection commands, via a connection 86, from a circuit 85. Register 89 receives only return commands from circuit 85, via a connection 87. The corresponding stage outputs of registers 88 and 89 of each board 80 are connected to the associated interface circuit 82 for controlling the coils of FIG. 1, but the inverter 83 is no longer necessary. All the circuits 82 receive from the memory 50 over lead 73 a transfer instruction which enables the knobs to be ordered to change state simultaneously when the readout of a signal combination has been completed.

Circuit 85 determines which knobs are to change state. It is necessary for the state of the knobs to be read at the same time as a recorded signal combination is transferred from the memory 50 to the registers. The states of the knobs are transmitted to circuit 85 by an input connection from register 40. Control circuit 85 compares the word read from the memory with the word representing the state of the knobs, bit by bit, and emits two words of 256 bits, the first to move certain knobs to the selecting position when they are in the return position and the second to move other knobs to the return position when they are in the selecting position. As an example, the circuit 85 supplies a "1" bit to connection 86 (selecting order) when the previous state of the corresponding knob is represented by a "1" bit (the return position) and when the bit read from the memory is "0" (selecting position). Similarly, it supplies a "1" bit to connection 87 (a return order) when the state of the knob is represented by a "0" bit (selecting position) and when the bit read from the memory is "1" (return position). Both lines 86, 87 carry "0" bits in all other instances. In the light of the foregoing explanation it will be easy to design and produce such a circuit using logic functions which are currently available. The circuit of FIG. 2 slightly increases the complexity of the system but on the other hand avoids an unnecessary consumption of energy in those knobs whose state does not have to change.

Figure 3:
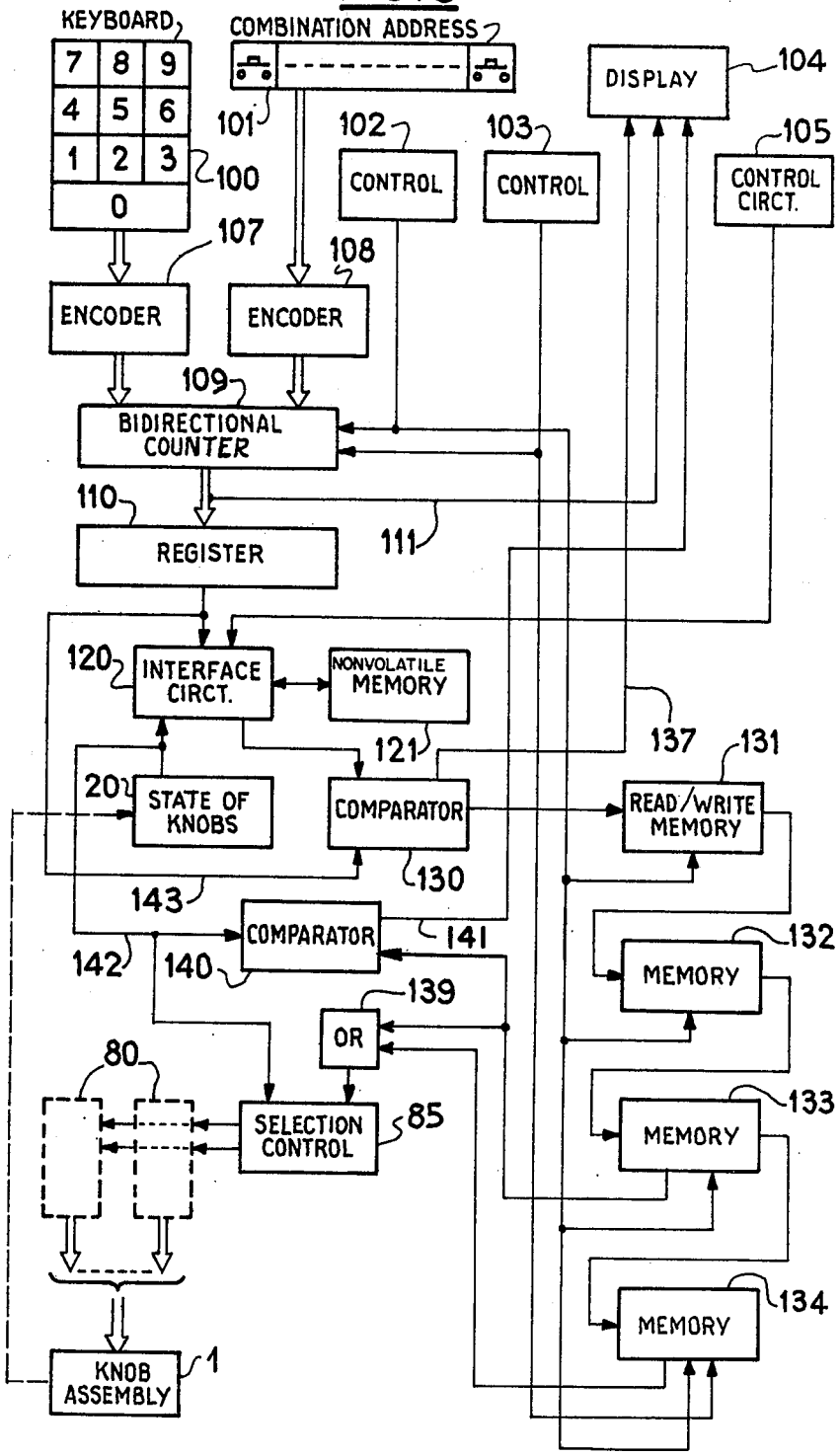
FIG. 3 is a detailed view of the entire system according to the invention.

FIG. 3 shows all the circuits of a system according to the invention. A nonvolatile memory 121 employs a flexible disk containing for example seventy-seven tracks subdivided into thirty-two sectors each able to record one signal combination. The memory 121 is associated with an interface circuit 120 which is generally incorporated in the memory so that, to gain access to a sector either to write a combination in it or to read one from it, it is merely necessary to supply the interface circuit 120 with the address of the sector and to generate a read or write command by means of a control circuit 105 and then, when the memory indicates it is ready to perform the operation requested, to feed in the information to be written or to collect the recorded information.

The set of state contacts belonging to the stop-actuating keys or pushbuttons, the associated diode matrix, and the register which emits the 256-bit words defining the state of the knobs are represented by a block 20 as in FIG. 1. The combination defined by the sixteen words of sixteen bits each is stored in a read/write buffer memory of the series type at the requisite time before being transferred to the interface circuit 120. This buffer memory, although not shown in FIG. 1, forms part of block 20.

A combination is called up in the main memory 121, with a view to setting the stop knobs to the selecting or return position, on the one hand from a set of pushbuttons 101 which specify a combination in a rank, and on the other hand from a keyboard 100 having eight or ten keys on which the player formulates the number of the combination rank selected. The player also has available controls to advance the signal combinations step by step to allow either the succeeding combination in the memory (control 102) or the preceding combination (control 103) to be called forth.

The player also has available a display device 104 which indicates to him the number of the rank and the combination within the rank which are in use. This display may also indicate certain breakdowns, errors, or other items of information.

Present-day instruments normally have pushbuttons to specify ten to twenty combinations. Thus, I prefer to organize the classification into groups of sixteen combinations to restrict the number of buttons on the console of the instrument. Each track on the disk is therefore divided into two groups of sixteen combinations and the player will have to choose from among $2\times77=154$ rank addresses (keyboard 100) and sixteen combination addresses (panel 101).

The rank address is generated by the keyboard 100, which may have only eight keys (in lieu of the ten actually shown) and which is coupled to an encoding circuit 107 comprising for example three integrated priority encoders. The first time the keyboard is pressed it is connected to the first encoder, the second time to the second encoder and the third time to the third encoder. There are obtained in this way eight rank-address bits, i.e. seven bits for the track number on the magnetic disk and the eighth bit for one of the two ranks in the track. Similarly, the sixteen pushbuttons 101 for the combinations are connected to an encoding circuit 108 which supplies four bits for the address of a combination in the rank selected on the keyboard. The address code formulated on the console is then stored in a bidirectional counting register 109 which can be loaded to any desired value. The sequential-shift controls 102 and 103 are also connected to the up-counting and down-counting inputs, respectively, of the reversible counter 109 to bring about a step-by-step forward or backward shift of the address in the register.

The output of the reversible counter 109 is connected to a storage register 110 of the same capacity and to the display device 104 to enable the player to check what he has selected. The register 110 is connected to the interface circuit 120 and is used to control the correct positioning of the read/write head of the disk memory. The twelve bits of the complete address are distributed as follows:

The first seven bits represent the track address. When voltage is applied to the system, the magnetic head of the memory 121 automatically positions itself in front of track 0. The disk rotator then indicates "track 0" and this information is used to zeroize a nonillustrated two-way counter giving the position of the head by counting up or down the number of steps which the motor driving the head is instructed to take. To enable the head to be positioned at the desired track, a bit-by-bit comparator compares the address indicated by the first seven bits from register 110 with the state of the two-way counter associated with the head. An order for forward or reverse movement, in the form of a train of pulses, is then transmitted to the stepping motor and to the associated two-way counter. All the logic for this operation is of course incorporated in the disk memory 121 or in the interface unit 120 which is generally equipped with the electromechanical parts of the disk reader/writer.

For safety reasons, the address of a signal combination (i.e. of a corresponding storage area of memory 121) is also recorded on the disk as an identification code to permit checking that the address read from the disk is in fact the same as the address given to the memory. This involves a redundancy of information but the assurance provided thereby is indispensable for the player of an organ work. A comparison between the identification code read and the address code selected is performed by a comparator 130 connected to the output of interface circuit 120 and to the output of address register 110. This comparator, shown in detail in FIG. 4, at the same time supplies the combination recorded at the desired address which is then used to control the stop-actuating knobs.

If the comparison circuit 130 detects that the address read and the address emitted by register 110 are not the same, the display device 104 is caused to indicate an error by means of a connection 137. Alternatively, an automatic search procedure may be initiated. This procedure may cause the disk to move one step forward or back. If the result is still wrong, there is a fresh shift. An alarm signal then appears when the text read is that of the first or last combination. The error may derive from a defect in the disk or from erasure of some of its contents. The alarm indicates to the player that the disk is not the correct one.

After a combination address has been selected via the keyboard 100 and the pushbuttons 101, the comparator 130—if there is no error—passes on the combination to a first ancillary read/write memory 131. This memory is followed by three other, identical read/write memories 132, 133 and 134 with the object of storing four successive signal combinations. The selected combination, whose address is n, is stored in read/write memory 133. Memory 132 contains combination $n+1$, memory 131 contains combination $n+2$, and memory 134 contains combination $n-1$, which was the combination used by the player before combination n.

The advantage of this arrangement is that, when the combinations to be used are in a sequence, the two combinations which follow the one extracted from memory 133, as well as the combination preceding it in the sequence, are immediately available to the player simply by the reading of a read/write memory, whose access time is negligible, and do not have to be read directly from the disk. This advantage obviously no longer exists if the player calls up the combinations in a random and non-sequential fashion. In the sequential mode, this feature of my invention affords a switchover speed equal to that of a system employing fast-access read/write memories but at the same time provides the safety of a magnetic memory in the event of a breakdown or interruption in the current supply.

Each time the disk is read in the random mode, three successive combinations are read out in such a way that the combination called up by the keyboard and the pushbuttons is transferred to memory 133, given that the three memories 131, 132 and 133 are loaded in series. In the sequential mode, the next combination is called up by shifting the contents of the read/write memories. The disk is read only to place a new combination $n+2$, replacing the extracted one, in the memory 131 whose contents will have been transferred to memory 132. This reading of the disk does not necessarily take place at high speed, as was explained above. Reading is initiated in the sequential mode by control buttons 102, 103 which operate to transfer the data stored in one of the ancillary memories 133, 134 to the boards 80 for controlling the stop-actuating knobs. An OR circuit 139 thus receives either the combination n supplied by memory 133 or the combination n−1 supplied by memory 134. The combination is then applied to circuit 85, which compares the combination extracted from the ancillary memory and the state of the knobs on the console and determines which knobs have to change, as described with reference to FIG. 2. The state of the stops is transmitted to circuit 85 by a connection 142.

A comparator circuit 140 is also used for recording combinations on the disk. The state of the knobs on the console is compared, by means of connection 142, with the combination recorded, which is immediately read and transferred to memory 133. If the combination recorded does not agree with the state of the console, an error signal is transmitted, via a connection 141, to the display device 104.

Figure 4:
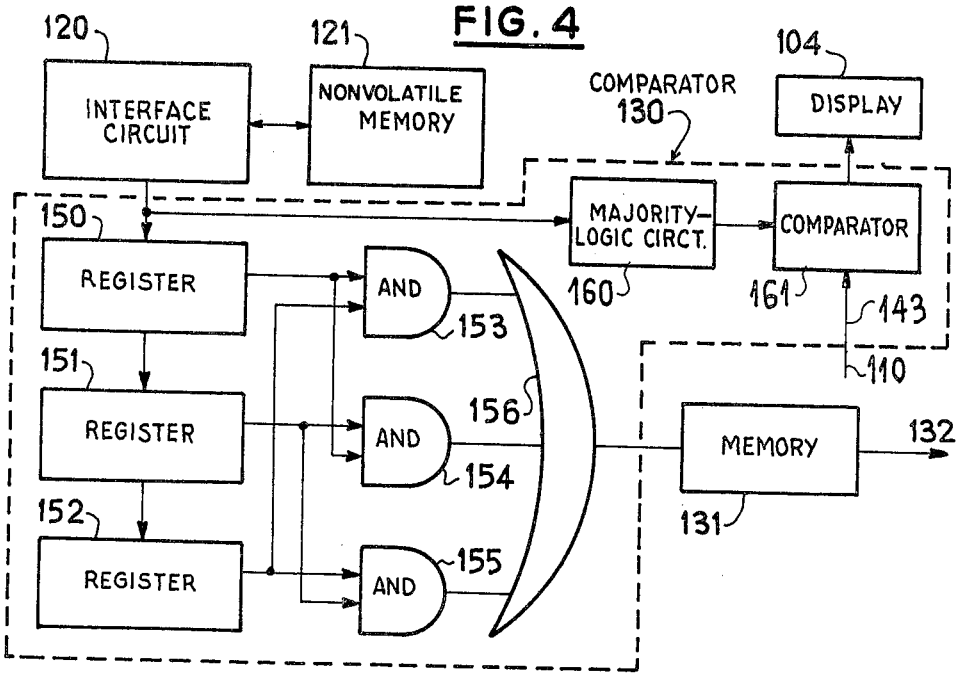
FIG. 4 shows a detail of the circuits for reading the recordings.

FIG. 4 shows an embodiment of the circuit 130 which is designed to compare the address asked for by the player with the address read from the disk and to supply the combination recorded at this address.

This comparator, as described above, is connected to the interface circuit 120 of the memory 121.

It contains a first majority-logic circuit 160 which serves to compare three successive recordings of the address on the disk and which emits the address of the corresponding signal combustion only if at least two recordings are identical. The address read is then compared bit by bit with the address selected, which comes from register 110, in a comparator 161.

The circuits for reading the combination also comprise majority-logic circuits identical with those for the address; they are shown in detail so that their operation may be more clearly understood. The combination is also recorded on the disk three times and the three recordings are compared two by two.

Figure 6:
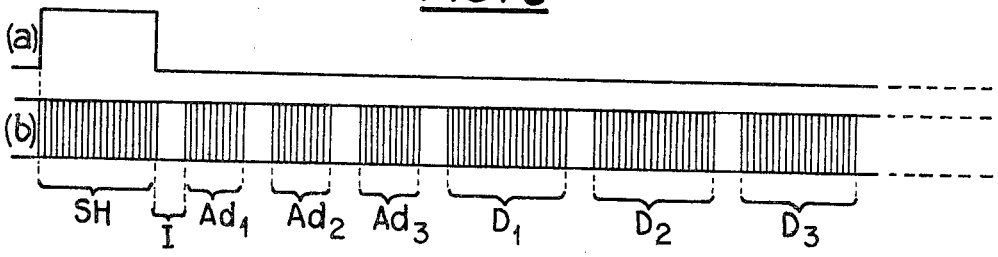
FIG. 6 is an example of a recording.

Graph (a) of FIG. 6 shows an index marker which is a synchronizing pulse defining a sector or storage area of a track on the disk that contains a recording of a combination.

Graph (b) of FIG. 6 shows the recording in this sector. The grouping SH, which is synchronous with the sector index marker, contains 128 clock bits required to synchronize the disk rotator. Space I then contains eight bits to indicate the arrival of data. Then there are three 12-bit address entries $Ad_1$, $Ad_2$ and $Ad_3$, which may be separated by gaps, and finally there are three entries $D_1$, $D_2$ and $D_3$ of the corresponding signal combination, each of 256 bits.

The index or sector mark SH accompanied by the synchronizing pulse of FIG. 6, which is characterized by 128 clock bits read from the disk, enables the start of a read sequence to be identified. The eight-bit signal I by which it is followed indicates the imminent arrival of an address/combination grouping.

The address-identification code and the selected signal combination are each recorded three times for reasons of safety in writing and readout. Though more of the memory is thus taken up by data and there is a redundancy in the formation written and read, these disadvantages are insignificant since the total length of an address/combination grouping which is recorded three times, with a gap between successive sets of data, is only about four milliseconds, which means that thirty-two sectors can easily be recorded per track. A disk containing seventy-seven tracks thus allows up to 2464 combinations to be stored, which is perfectly adequate even for an extremely sophisticated instrument. Even a disk containing only sixty-four tracks can store up to 2048 combinations, which is still entirely acceptable.

The majority logic shown in FIG. 4 thus makes use of this redundancy in the information recorded in a sector to supply on the one hand the address read (circuit 160) and on the other hand the combination read (circuits 150 to 156) with a very high degree of reliability. Since the majority-logic circuits for reading the address are identical, except for the capacity of the storage registers, with those intended for reading the combination, only the latter are shown in FIG. 4.

Three such series-input/series-output storage registers 150, 151 and 152 are connected in cascade. The three successive combinations $D_1$, $D_2$ and $D_3$ read from the disk are stored in registers 152, 151 and 150, respectively. The registers then emit the three combinations $D_1$, $D_2$ and $D_3$ simultaneously. Three AND gates 153, 154 and 155 each concurrently receive two combinations on respective inputs thereof. Gate 153 thus compares combinations $D_3$ and $D_1$ bit by bit, gate 154 compares combinations $D_2$ and $D_3$, and gate 155 compares combinations $D_1$ and $D_2$. The three outputs of the AND gates are coupled to respective inputs of an OR gate 156 which emits the recorded combination with a minimum likelihood of error. This combination is then applied to the memory 131. As indicated above, the reading process takes place three times, from three successive sectors or storage areas of the disk, that is to say at three adjoining locations, in order to load the ancillary memories 131, 132 and 133.

Figure 5:
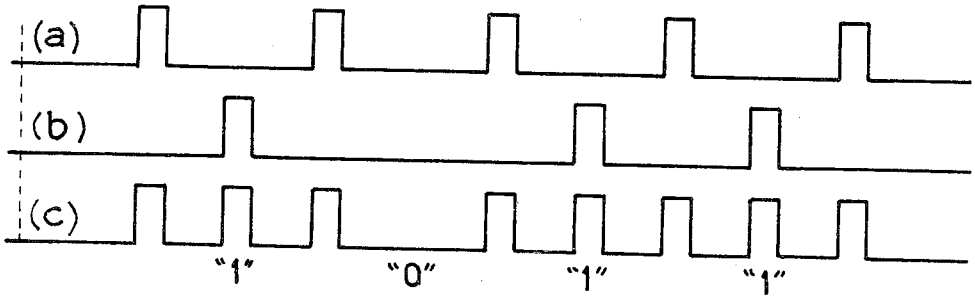
FIG. 5 is an example of the form of the signals used by a magnetic-disk memory included in the system.

FIG. 5 shows the form of the signals used to record data on the magnetic disk.

The disk rotator needs to receive clock signals (a) which are formed by regularly spaced calibrated pulses, and data signals (b) to be recorded which are formed by pulses offset by half a clock cycle from the clock pulses. A "1" bit is expressed by a pulse being present and a "0" bit by the absence of a pulse in the gap between clock pulses. The data bits are thus supplied to the disk rotator at the same repetition frequency as the clock pulses. At the time of recording the clock pulses, the data bits are interleaved, which is shown in graph (c). On readout, the clock pulses on the one hand and the data bits on the other hand are separated by special circuits incorporated in the circuitry of the disk rotator. The clock pulses are used to synchronize the clock external to the disk which is situated in interface circuit 120 (FIG. 3).

The interface circuit 120 also generates a number of different instructions for the operation of the disk rotator. These are signals applied to the read/write head, to authorize writing, for the direction of the stepping motor, for tracks, for step-by-step advance, for erasure, etc. These orders will be specified and explained in detail by the manufacturer of such recording apparatus.

It is possible to provide means for preventing erasure of all or any part of the disk contents, in order to preserve the composing work which has been done by the player.

The disk rotator supplies the interface circuit 120 with various signals which enable data to be extracted with complete overall synchronization. These synchronization signals include a "track-0 index marker" which indicates that the head is situated at track 0, a track marker which defines an angular point of origin on the disk, using for this purpose one or more holes pierced in the disk, and sector index markers as shown at (a) in FIG. 6.

Depending upon the design selected, the disk rotator may also supply "writing not possible" signals which indicate that one of the following conditions is not satisfied:

the disk is in place;

the speed of the disk is correct;

the information to be written is available;

the gate of the disk rotator is closed;

the head is in working position, i.e. pressed against the disk.

An indicator lamp may light up in this case, being red if a condition is not fulfilled and green if all the conditions are fulfilled (i.e. the disk is ready).

I may also provide an additional yellow light which indicates that writing is impossible, or forbidden, owing to the fact that a recording previously made on the disk must not be erased. In this case reading is still possible. These lights may be independent of the display device 104 or may form part of it.

A clock forms part of the interface circuit 120 of FIG. 3. This clock is primarily used in preparing a new disk when it is blank. Its frequency is 250 KHz, for example. The clock pulses are transcribed onto the disk.

At the time of writing or reading, the frequency and phase of the clock are governed by the pulses read from the disk. Use is made of a conventional phase-locking loop. The clock is formed for example by an oscillator whose frequency is voltage-controlled.

If the entire system according to the invention makes use of this clock, it must be of high quality.

The operation of the system shown in FIG. 3 can be deduced from what is said above.

Nevertheless, a brief summary of the operation will be given in respect of recording and reading.

At the time of recording, the player selects a combination of stops. The state of the knobs is read by means of the circuits of FIG. 1 (block 20 in FIG. 3). The combinations is ready to be recorded as soon as an instruction is emitted by the interface circuit 120. The player assigns to this combination an address by using the keyboard 100 and the pushbuttons 101. This address is transmitted to the interface circuit 120 which then makes a recording at the appropriate location. Immediately after this there is a readout which is compared with the state of the stops to confirm to the player that the system is operating correctly. A comparison is made in respect of two items, namely the address in circuit 130 and the combination in circuit 140.

At the time of reading, the player selects an address which causes the contents of the main memory 121 at this address and at the two following addresses to be read out to load ancillary memories 131, 132 and 133.

Before this, circuit 130 will have compared the selected address and the recorded address.

When combinations are being selected randomly, this operation is repeated upon each fresh selection. It requires the disk rotator to be brought into action, the reading head to be positioned correctly and three successive combinations to be read. This mode of selection involves an access time which is fairly long but still acceptable (a few hundred milliseconds). The access time can be shortened by transferring the first combination, which is read out and stored in memory 131, directly to the control boards for the actuating knobs, without the two following combinations being read, rather than transferring the combination stored in memory 133 to them.

In sequential selection, the access time is shorter since the next two combinations are already available in memories 132 and 131 and the previous combination is stored in memory 134.

When the player operates the sequential-shift control 102, the combinations are advanced in the cascaded memories 131 to 134. Since memory 131 is empty, a reading operation is automatically performed on the disk to load this memory. The time taken by this operation is thus of no relevance to the player.

Figure 7:
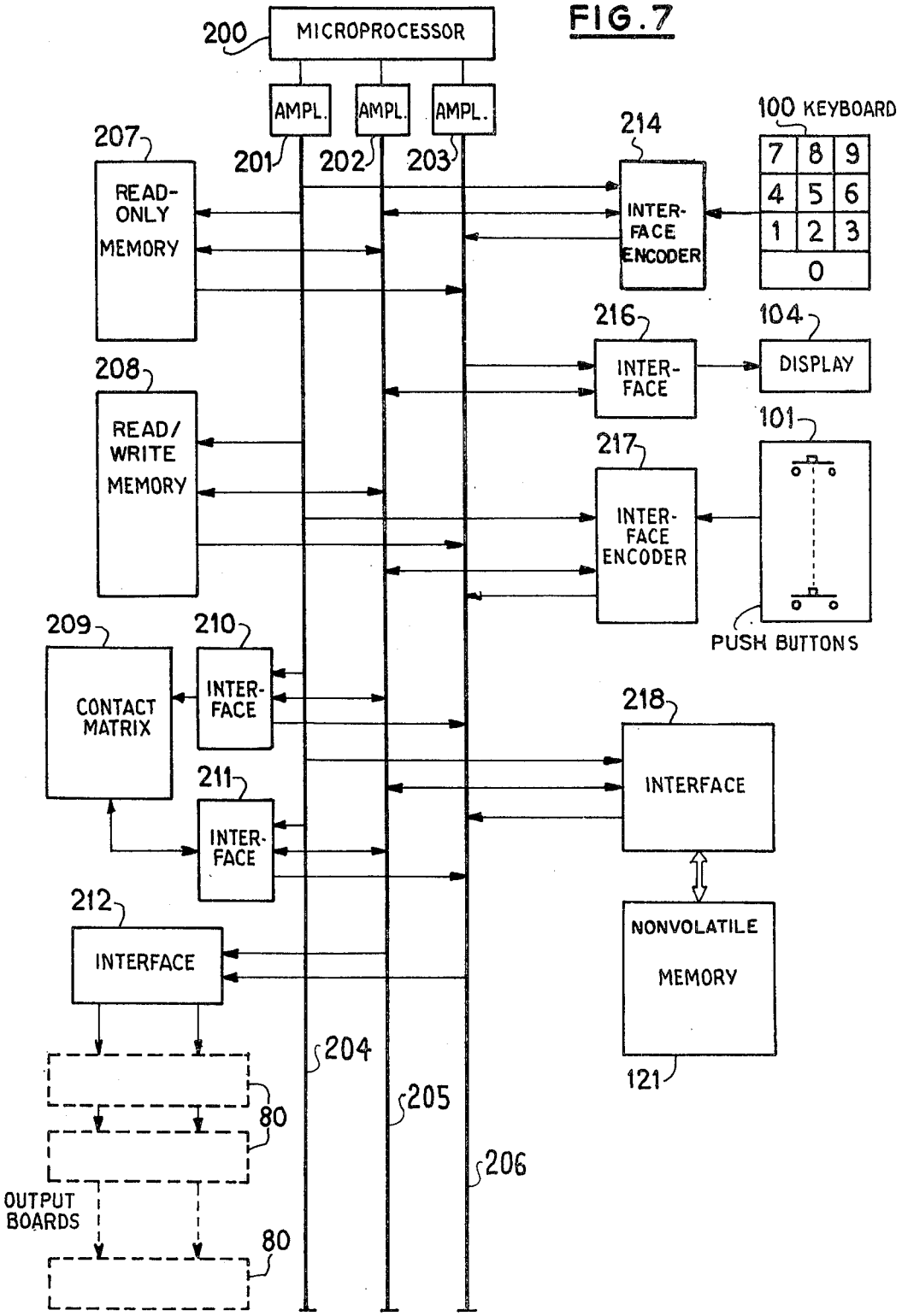
FIG. 7 is a block diagram of an embodiment of the invention based on a microprocessor circuit.

FIG. 7 shows another embodiment of the invention based on a microprocessor circuit 200.

At the present time microprocessors of this kind are widely available. The microprocessor has three main inputs by means of which it communicates with the other components of the system. Three power amplifiers 201, 202 and 203 are inserted between the microprocessor and respective transmission lines or buses 204–206 designed to couple the microprocessor to the other components. Line 204 is the address bus, line 205 is the control bus and line 206 is the data bus.

All the components of the stop-actuating circuit are coupled to either two or three buses including bus 205 which controls the overall system and which carries the control signals for all the components. These control signals are formed by words consisting of a certain number of bits, some of which act as addresses so that the instruction which is represented by the other bits will be given to the correct component. The components of the system are thus associated with respective interface circuits which receive and decode the instructions transmitted by the control bus so that each instruction will be carried out. These interface circuits are similarly responsible for matching the data and the addresses in the direction from a component to the microprocessor or in the opposite direction.

Thus, a contact matrix 209 similar to that shown in FIG. 1 enables the position of the stop-actuating knobs to be detected. An interface circuit 210 which is connected to all three buses scans the rows of the matrix by means of control and address signals. The information relating to the number of the row is transmitted to the data bus 206. Similarly, an interface circuit 211 is responsible for scanning the columns in a sequential fashion to transmit the 256 state bits from the console to the microprocessor via the data bus.

The output boards 80, which are preferably identical with those shown in FIG. 2 but could also conform to those shown in FIG. 1, are used for setting the console. Moreover, there is an interface circuit 212 which receives the state data and transfers them, in response to control signals, to the registers for controlling the change of state of the knobs.

The nonvolatile memory 121 of the system is shown associated with an interface unit 218 which converts the control signals received from bus 205 into orders to record or to read. The signals to be recorded or the bus signals are picked up from or transmitted to the data bus 206. The address bus 204 allots the various signals to the components concerned.

The system of FIG. 7 utilizes the aforedescribed assembly of player-operated selectors comprising the keyboard 100, which is coupled to the buses via an encoding interface circuit 214, the combination pushbuttons 101 with their interface encoder 217, and the display device 104 with its interface unit 216.

I further provide program memories 207, which are of the read-only type programmed in such a way that the system will perform the above operations, and working read/write memories 208 which also act as buffer stores, such as the register 110 in FIG. 3 which contains the address word for a selected combination, or as back-up memories for the sequential transfer of the combinations n, n+1, n+2 etc. similar to the ancillary memories 133, 132, 131.

The various components which form the system according to the invention are known per se and realizable by persons skilled in the art. Each microprocessor manufacturer will lay down the characteristics of the interface circuits for this purpose and the fact that the microprocessor is microprogrammed makes it easier to design, produce and set up the circuitry.

One of the chief features of the present invention is the use of a memory 121 of the nonvolatile type. At the present time, flexible-disk memories are easy to use and moderate in price. Other kinds of nonvolatile memory may also be used instead of or in conjunction with the flexible-disk memory. A plurality of disk memories or the like may also be used.

Magnetic-bubble memories are thus of interest for possible use since in them the recorded data are of a non-volatile nature and, despite the fact that they are substantially more expensive at present than disk memories, they have a larger capacity per unit volume and a shorter access time. Such memories are formed by a thin magnetic film in which each data bit is represented by a tiny, substantially cylindrical domain (or bubble) whose direction of magnetization is opposite that of the thin film. Large numbers of bubbles may thus exist in a thin-film structure of small size. Magnetic circuits arranged around the thin film create a rotating magnetic field which causes all the data in the memory to rotate. Recording heads produce bubbles when it is desired to store information, and reading heads, of the Hall-effect kind for example, read the data which have been written. The access time of bubble memories is less than that of disk memories by a factor ranging between 50 and 100, which makes it possible to contemplate dispensing with ancillary memories for storing the successive combinations, such as memories 134, 133, 132, 131 of FIG. 3.

In comparison with disk memories, bubble memories are also more reliable thanks to the fact that all the parts of which they consist are stationary, whereas in a disk memory the disk turns about an axis at high speed and the read/write head is also movable to have access to the various tracks of the disk.

While I have described the present invention as particularly designed for pipe organs, it is also applicable to electronic organs which likewise have a large number of stop-selecting knobs on a console. In this case, the stop-selecting knobs switch on or off a set of square-wave or sinusoidal electrical signals which, when combined in the instrument, give a certain timber to the sounds emitted when the player uses the keyboard or keyboards.

As in the case of pipe organs, the system according to the invention may be coupled to such an instrument without the need for major alterations provided that the actuating knobs are replaced by electrically controlled types of the kind shown in FIG. 1. or the like.

In fact, the majority of present-day instruments already have electrical controls for selecting and returning stops which use a single working contact per stop knob. It is possible to use such a one-armature switch in place of the two-armature switch shown in FIG. 1. The moving contact or armature is maintained at all times at a potential U of 14 volts, for example. The fixed contact, which is connected to the wind-chest 10, is therefore at a potential of 0 volt or U=14 volts depending on whether the knob is in the return or the selecting position. It is then merely necessary to use an electrical connection tied to the fixed contact of the electrical control switch to find the state of the knob. The voltage of 14 volts is reduced to approximately 4 volts by a potentiometric divider with a center tap whose potential is stabilized by a Zener diode and a capacitor. The output voltage from this attenuator is representative of the state of the knob: 0 volt for the return position (logic-0 state) and 4 volts for the selecting position (logic-1 state). This voltage is compatible with the digital devices used to put the invention into practice.

It is then no longer necessary to use the clock 21, the decoder 22, and the diode matrix of FIG. 1.

The words of 256 serial bits which are to be recorded are formulated using groups of 2×8 contacts (associated with their voltage dividers), which are connected for example to the inputs of two parallel-input/series-output eight-bit shift registers, similar to the registers 81 of FIG. 1 (or 88 and 89 of FIG. 2), connected in series and arranged on the same card as that used for the output circuits.

This improvement to the interconnections between the instrument and the system according to the invention has the following advantages:

the output boards become "input/output" boards, the grouping of the outputs into sixteens also applies to the inputs, and a single, multi-core cable is able to provide the connection between a knob and the corresponding board, the number of input/output boards is also a multiple of sixteen and it is not necessary to have all sixteen boards to form 256-bit words.

Finally, for readout there is no need to provide knobs with two armatures, which makes the arrangement according to the invention more versatile and results in only negligible alterations to the instrument.

I claim:

1. In a musical instrument having a multiplicity of independently movable stops provided with respective actuators electrically operable to displace said stops between selected and unselected positions, the combination therewith of:

nonvolatile memory means with a multiplicity of sequentially accessible storage areas each having recorded therein a combination of binary signals identifying the selected and unselected positions of respective stops;

a cascade of ancillary read/write memories connected to said nonvolatile memory means for consecutive loading with respective signal combinations from as many adjacent storage areas thereof;

a multiplicity of register stages with output connections respectively extending to said actuators;

player-operated selector means for identifying a storage area of said nonvolatile memory means containing a chosen signal combination and feeding the latter via a first memory of said cascade into a second memory of said cascade while loading said first memory with an adjacent signal combination;

control means connected to said second memory for reading out said chosen signal combination and converting same into positioning commands entered into said register stages and for immediately advancing said adjacent signal combination from said first memory to said second memory as a replacement of the chosen signal combination read out therefrom while immediately replacing said adjacent signal combination in said first memory with a further signal combination read out from the next-following storage area of said nonvolatile memory means whereby said cascade always contains a plurality of signal combinations substantially less than the number of said storage areas; and interface means inserted in said output connections for simultaneously transmitting said positioning commands to the respective actuators in response to a transfer instruction.

2. The combination defined in claim 1 wherein said cascade includes a third memory following said second memory for receiving therefrom said chosen signal combination upon the replacement of the latter by said adjacent signal combination, said control means being switchable to said third memory for optionally receiving the contents thereof in lieu of the signal combination written in said second memory.

3. The combination defined in claim 1 or 2, further comprising storage means connected to receive positioning information from all said actuators, said control means including comparison means with input connections to said nonvolatile memory means and to said storage means for emitting positioning commands only to those register stages whose actuators are associated with stops in positions different from those specified by the read-out signal combination.

4. The combination defined in claim 3 wherein said actuators are provided with switch contacts disposed at junctions of rows and columns of a diode matrix, further comprising high-speed clock means for scanning said diode matrix and transmitting data on the state of said switch contacts to said storage means, and low-speed clock means for transferring said data to said storage means.

5. The combination defined in claim 1 or 2 wherein said register stages are divided into two groups of cascaded series-input/parallel-output registers respectively receiving selection commands and return commands from said control means.

6. The combination defined in claim 1 or 2 wherein said control means includes a microprocessor.

7. The combination defined in claim 1 or 2 wherein said nonvolatile memory means comprises a magnetic-disc memory.

8. The combination defined in claim 1 or 2 wherein said nonvolatile memory means comprises a magnetic-bubble memory.

9. The combination defined in claim 1 or 2 wherein said player-operated selector means comprises a keyboard for identifying one of several sections of said nonvolatile memory means and an assembly of pushbuttons for identifying a storage area in the section so identified.

10. In a musical instrument having a multiplicity of independently movable stops provided with respective actuators electrically operable to displace said stops between selected an unselected positions, the combination therewith of:

nonvolatile memory means with a multiplicity of sequentially accessible storage areas each having recorded therein a combination of binary signals identifying the selected and unselected positions of respective stops;

a cascade of ancillary read/write memories connected to said nonvolatile memory means for consecutive loading with respective signal combinations from as many adjacent storage areas thereof;

a multiplicity of register stages with output connections respectively extending to said actuators;

player-operated selector means for identifying a limited group of adjacent storage areas of said nonvolatile memory means and successively loading the memories of said cascade with the signal combinations of said group;

control means connected to said cascade for reading out a chosen signal combination from any one of a plurality of memories of said cascade and converting the read-out signal combination into positioning commands entered into said register stages while replacing said read-out signal combination with an adjacent signal combination; and interface means inserted in said output connections for simultaneously transmitting said positioning commands to the respective actuators in response to a transfer instruction.

11. The combination defined in claim 1 or 10, further comprising comparison means with inputs connected to said player-operated selector means and to said nonvolatile memory means for comparing an address code from said selector means with an identification code registered in said memory means together with a signal combination to be read out therefrom to said cascade, said nonvolatile memory means containing at adjoining locations of each storage area three entries of the same identification code and of the associated signal combination, said comparison means including majority-logic circuitry for enabling the readout of a signal combination only upon ascertaining a match between at least two of the identification codes and at least two of the associated signal combinations entered at a selected address.

12. The combination defined in claim 11, further comprising display means controlled by said comparison means for indicating a mismatch between an address code and an identification code read out from said nonvolatile memory means in response to said address code.

* * * * *